United States Patent [19]

Cadoff et al.

[11] 4,162,430

[45] Jul. 24, 1979

[54] COMPACT BALLAST FOR FLUORESCENT LAMP WHICH PROVIDES EXCELLENT LAMP POWER REGULATION

[75] Inventors: Laurence H. Cadoff, Wilkins Township, Allegheny County; Douglas M. Mattox, O'Hara Township, Allegheny County; Robert T. Elms, Monroeville, all of Pa.

[73] Assignee: Westinghouse Electric Corp., Pittsburgh, Pa.

[21] Appl. No.: 910,814

[22] Filed: May 30, 1978

[51] Int. Cl.[2] ..... H05B 41/16

[52] U.S. Cl. ..... 315/309; 315/311; 315/DIG. 5

[58] Field of Search ..... 315/52, 58, 71, 246, 315/291, 307, 309, 311, DIG. 5

[56] References Cited

U.S. PATENT DOCUMENTS

| | | | |
|---|---|---|---|
| 2,247,198 | 6/1941 | Krefft et al. | 315/309 X |
| 2,312,429 | 3/1943 | Lucan | 315/309 X |
| 2,373,219 | 4/1945 | Besser | 315/49 |
| 2,976,505 | 3/1961 | Ichikawa | 338/22 |
| 3,044,968 | 7/1962 | Ichikawa | 252/520 |
| 3,271,622 | 9/1966 | Malagodi et al. | 315/246 |
| 3,921,032 | 11/1975 | Hallay | 315/309 X |
| 3,996,493 | 12/1976 | Davenport et al. | 315/58 |

FOREIGN PATENT DOCUMENTS

| | | | |
|---|---|---|---|
| 44-7972 | 3/1969 | Japan | 315/309 |
| 1072717 | 6/1967 | United Kingdom . | |

*Primary Examiner*—Eugene R. LaRoche
*Attorney, Agent, or Firm*—W. D. Palmer

[57] ABSTRACT

Compact ballast circuit for operating a low-pressure fluorescent lamp wherein line voltage is from about 120% to about 150% of the lamp operating voltage. The compact ballast comprises a positive temperature coefficient (PTC) resistance means and a parallel-connected fixed resistor, both connected in series with the ballasted lamp. Room temperature ohmic resistance of the PTC resistor is from about one-third to about twice the ohmic resistance of the fixed value resistor and the ohmic value of the fixed value resistor is sufficiently low that it will pass sufficient current to sustain the lamp discharge. The voltage drop across the combined ballast resistors is at least about 20% of the voltage across the operating lamp. The PTC resistor is selected to display a curve of resistance versus temperature which breaks and rises sharply after a predetermined operating temperature is achieved and the PTC resistor is associated with a heat sink to cause it to operate at about this transition temperature so that the operating PTC resistor has a relatively constant power dissipation within the range of from about one-third to about one-tenth of the rated lamp power consumption. The power regulation of the circuit is excellent under conditions of varying line voltage.

6 Claims, 3 Drawing Figures

COMPACT BALLAST FOR FLUORESCENT LAMP WHICH PROVIDES EXCELLENT LAMP POWER REGULATION

BACKGROUND OF THE INVENTION

This invention relates to fluorescent lamp ballast circuits and, more particularly, to a simple, compact, economical ballast circuit which has excellent power regulation under varying conditions of line voltage.

Most fluorescent lamp ballasting circuits are of one of three general types, namely, a lamp preheat type magnetic circuit, a lamp rapid start magnetic circuit, or a lamp instant start magnetic circuit. In preheat circuits, closing of the on-off switch permits a heating current to flow through the electrode at each end of the lamp and when a starter switch is opened, a high-voltage pulse is impressed across the electrodes which initiates the discharge between the electrodes. The starting circuit may be controlled by a munually operated switch or by an automatic make-and-break type of switch, which normally takes the form of a so-called glow starter. Once the discharge is initiated within the lamp, the current therethrough is controlled by a series-connected inductor or so-called choke.

In so-called rapid start circuits, the lamp electrodes are preheated for a short time prior to initiating the discharge and most such circuits are of the two-lamp series-sequence type in which the lamps start is sequence and thereafter operate in series with a current-limiting inductor.

In instant-start circuits, the discharge is initiated without any preheating of the electrodes by the application of a sufficiently high voltage. Such circuits can be of the lead-lag type or series-sequence type and once the discharge is initiated, the current through the lamps is limited by a ballasting inductor. All of the foregoing circuits are very well known and are extensively used.

It has been known for many years that fluorescent lamps can be ballasted by a fixed value resistor and a recent adaptation of such a ballasting arrangement is disclosed in U.S. Pat. No. 3,996,493 dated Dec. 7, 1976. An earlier adaptation of a wire-type resistance ballast having a positive temperature coefficient of resistance is disclosed in U.S. Pat. No. 2,373,219 dated Apr. 10, 1945 wherein the PTC wire resistance is used to control the potential applied to the starting electrodes of a specific fluorescent discharge device.

Material which display a positive temperature coefficient of resistance are well known, such as described in U.S. Pat. No. 3,044,968 dated July 17, 1963, and U.S. Pat. No. 2,976,505 dated Mar. 21, 1961.

In U.S. Pat. No. 3,271,622 dated Sept. 6, 1966 is disclosed a piezoelectric ballast apparatus for fluorescent lamps, and one suggested material for such a ballast is barium titanate, which is an excellent PTC material, see column 2, line 49 of this patent. It has also been suggested to control the power input to a fluorescent lamp by placing a barium titanate (PTC) resistor in series with a choke, as described in Japanese Utility Model No. 44-7972 dated Mar. 3, 1969. PTC resistors to replace glow switch starters in fluorescent lamps are described in British Pat. No. 1.072,717 dated June 17, 1967.

SUMMARY OF THE INVENTION

There is provided a circuit for operating a low-pressure, positive-column, mercury-vapor discharge device which is adapted to be operated with a predetermined AC rms voltage thereacross and a predetermined rms current therethrough to establish a predetermined rated power consumption therein, and the discharge lamp requires a starting and reignition voltage which exceeds the operating voltage by at least a predetermined amount. The circuit comprises input terminals which are adapted to be connected to a predetermined AC rms line voltage which is from about 120% to about 150% of the predetermined lamp rms operating voltage. Ballast means are connected in series with the lamp to be operated and the series-connected lamp and ballast are connected across the input terminals. The ballast means comprises a parallel-connected positive temperature coefficient (PTC) resistor and a fixed value resistor, and the relative values of the PTC resistor and the fixed value resistor display the following relationship with respect to one another and with respect to the lamp to be operated: (1) the room temperature ohmic resistance of the PTC resistor is from about one-third to about twice the ohmic resistance of the fixed value resistor; (2) the ohmic resistance of the fixed value resistor is sufficiently low that it will pass a current of sufficient magnitude to sustain a discharge in the operating lamp; and (3) the rms voltage drop across the combined ballast during operation of the lamp is at least about 20% of the rms lamp operating voltage in order to provide for adequate starting voltage and to provide adequate reignition voltage at the beginning of each half cycle of energizing potential. The PTC resistor is selected to display a curve of resistance vs. temperature which breaks and rises sharply after a predetermined PTC resistor transition temperature is reached. The PTC resistor is associated with a suitable heat sink means to cause the resistance of the PTC resistor to be maintained during lamp operation at about its transition temperature so that the PTC resistor will have a relativley constant power dissipation therein within the range of from about one-third to about one-tenth of the lamp rated power consumption. To maintain the PTC resistor at about its trasition temperature, the PTC resistor ad the fixed value resistor are thermally insulated from one another.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
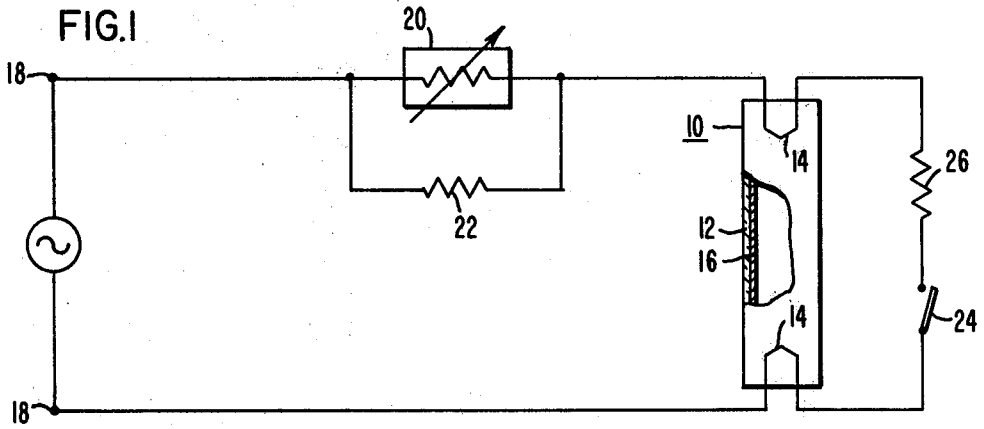
FIG. 1 is a schematic circuit diagram of the present lamp ballasting circuit including a suitable switch starting circuit.

With respect to the diagrammatic circuit shown in FIG. 1, the fluorescent lamp 10 is a conventional 20 watt lamp comprising a tubular shaped envelope 12 of T12 dimensions (1.5 inches diameter or 3.8 cm) having electrodes 14 operatively disposed proximate the ends thereof and carrying a phosphor coating 16 on the envelope interior surface. The discharge sustaining filling in such a lamp is a small charge of mercury and a few torrs of inert, ionizable starting gas. Such lamps are designed to have a power consumption of 10 watts per foot of envelope length. Typically, such a lamp is adapted to be operated with a predetermined AC rms voltage thereacross, such as 50 volts, and a predetermined rms current therethrough, such as 400 ma, in order to establish a predetermined rated power consumption of 20 watts therein, although these rated values may vary slightly depending upon the circuit. Such a discharge lamp requires a starting voltage which exceeds the lamp operating voltage by at least a predetermined amount which is at least about 120% of the lamp operating voltage and for continuing operation, there is required to be applied across the lamp electrodes a similar reignition voltage at the beginning of each half cycle of the lamp operating voltage.

Considering the circuit shown in FIG. 1, it comprises input terminals 18 which are adapted to be connected to a predetermined AC rms line voltage source which is from about 120% to about150% of the predetermined lamp rms operating voltage. The lower limitation of the line voltage is to provide sufficient voltage for starting and reignition. If the line voltage exceeds the lamp operating voltage by more than about 150%, there will be an excessive power loss in the resistive ballast, which will impair the overall circuit efficiency.

The ballast means are connected in series with the lamp to be operated and the series-connected ballast means and the lamp 10 are adapted to be connected across the input terminals 18. The ballast means comprises a parallel-connected positive temperature coefficient (PTC) resistor 20 and a fixed value resistor 22. The relative values of the PTC resistor 20 and the fixed value resistor 22 display the following relationship with respect to one another and with respect to the lamp 10 to be operated:

(1) The room temperature ohmic resistance of the PTC resistor 20 is from about one-third to about twice the ohmic resistance of the fixed value resistor 22. If the cold resistance of the PTC resistor is less than about one-third of the fixed resistor, power regulation can suffer and the current inrush encountered when the PTC resistor is cold may damage the lamp after prolonged operation. If the cold resistance of the PTC resistor is more than twice the value of the fixed resistor, the power regulation of the present circuit is not as good as desired.

(2) As a second parameter, the ohmic resistance of the fixed value resistor 22 should be sufficiently low that it will pass a current of sufficient magnitude to sustain a discharge in the lamp. The PTC resistor operates at about its transition temperature, as explained hereinafter, and if sudden voltage drops are encountered with the PTC resistor at about its transition temperature, the majority of the lamp operating current will have to pass through the fixed value resistor.

(3) As indicated hereinbefore, the rms voltage drop across the parallel-connected PTC resistor 20 and the fixed value resistor 22 during operation of the ballasted lamp should be at least about 20% of the rms lamp operating voltage to provide for adequate starting voltage for the lamp as well as providing adequate reignition voltage for the lamp at the beginning of each half cycle of the lamp operating potential.

Figure 2:
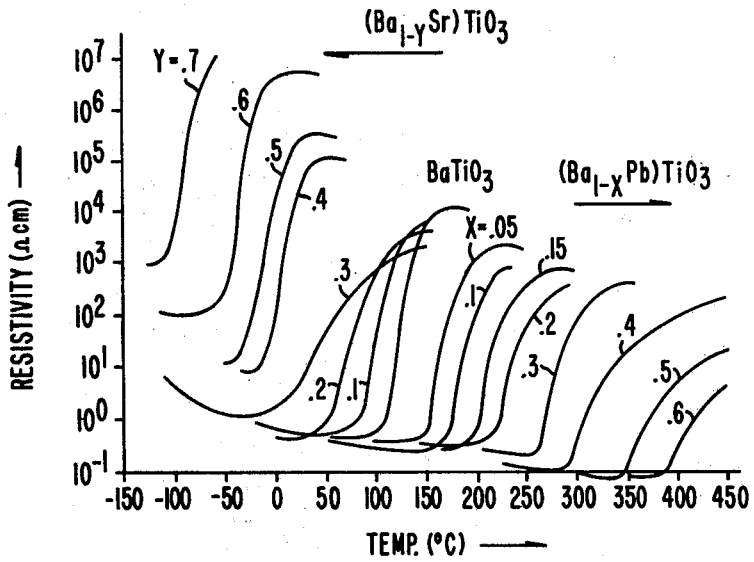
FIG. 2 is a graph of resisivity vs. temperature illustrating the sharply breaking curves which are obtained with PTC materials formed of barium titanate and modified titanate ceramic materials.

The PTC resistor 22 is so selected that it will display a curve of temperature versus resistance which breaks and rises sharply after a predetermined PTC resistor transition temperature is reached. Barium titanate ceramic modified by incorportion of strontium or lead provides an excellent PTC material for this application and performance curves for these materials are shown in FIG. 2. A preferred transition temperature is 120° C.–125° C. which is readily achieved with a barium titanate ceramic although the material could be modified so that the transition temperature is from 85° C. to 160° C.

There is also associated with the PTC resistor 20 a heat sink means or device in order to cause the resistance of the PTC resistor to be maintained during lamp operation at about its transiston temperature and with a relatively constant power dissipation within the range of from about one-third to about one-tenth of the lamp rated power consumption. By keeping the power consumption relatively constant in the PTC resistor, at lower line voltages it provides the major ballasting effect and at greater than nominal line voltages, the fixed resistor provides the major ballasting effect. If the power dissipation in the PTC resistor is greater than about one-third of the lamp rated power consumption, the circuit efficiency drops excessively and if the power dissipation in the operating PTC resistor is less than about one-tenth of the lamp rated power consumption, there may be insufficient voltage drop across the ballast to provide for lamp reignition. With the PTC resistor maintained at about its transition temperature during normal lamp operation, there will be a relatively constant power dissipation therein and the PTC resistor 20 and the fixed resistor 22 should be substantially thermally insulated from one another.

To complete the circuit as shown in FIG. 1, a conventional manual (i.e., mechanical), electronic or thermal switch starter 24 is provided in series circuit relationship with a starting resistor 26 in order to preheat the lamp electrodes 14 to facilitate proper operation and starting of the lamp 10. Such a switch 24 is conventional and once the lamp is operating, the switch opens to remove both it and the starting resistor from the circuit.

Figure 3:
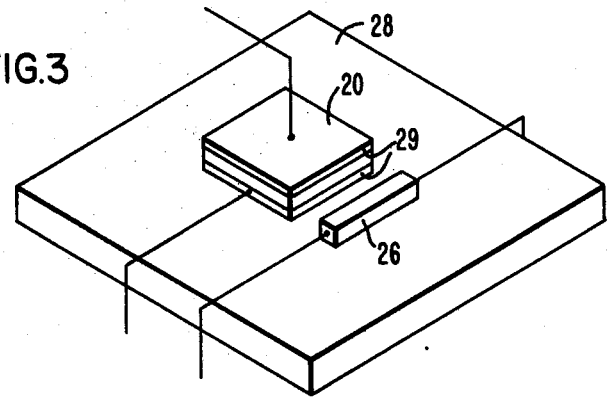
FIG. 3 is an enlarge isometric view of a barium titanate PTC resistor and its associated heat sink together with a fixed value starting resistor placed in heat-transfer relationship therewith.

A suitable PTC resistor 20 is shown in FIG. 3 and the dimensions of the barium titanate PTC resistor are 0.6 cm×1 cm×0.1 cm with the weight being slightly less than 0.4 gm. Both sides of the barium titanate resistor 20 have bonded thereto electrodes 29 formed of an indium alloy such as marketed by Indium Corp. of America under the trademark "Indalloy 12". The assembly is affixed to a heat sink member 28 which, as a specific example, is formed of aluminum having dimensions of 1/16 in. (1.9 mm)×2 in. (5.1 cm)×2 in. (5.1 cm). The starting resistor 26 may also be disposed on the heat sink member 28 in heat transfer relationship with the PTC resistor 20, in order to facilitate rapid stabilization of the circuit after starting, as will be described hereinafter.

Considering now a specific example for operating a 20 watt fluorescent lamp from an input line voltage of 70 volts, 60 Hz, the PTC resistor is designed to have a switching or Curie temperature of 125° C. and at rated line voltage, it is designed to have a power consumption of approximately 5.1 watts. The fixed resistor 22 is also designed to have a rated power dissipation which is preferably about the same as the power dissipation in the PTC resistor, with the resistance of the fixed resistor being approximately 90 ohms. In such a circuit the fixed resistance of the starting resistor 26 is approximately 50 ohms. In the following Table I is shown the performance of such a circuit as compared to the comparative performance of a ballast comprising only a fixed resistor and a conventional inductive ballast.

TABLE I

| Fixed Resistor Ballast | | Inductive Ballast | | PTC-Fixed Resistor Ballast | |
|---|---|---|---|---|---|
| Input Voltage | Lamp Power | Input Voltage | Lamp Power | Input Voltage | Lamp Power |
| 65 V | 11.5 W | 111 V | 14.5 W | 65 V | 18.5 W |
| 70 V | 20 W | 120 V | 16.5 W | 70 V | 19.1 W |
| 75 V | 26 W | 119 V | 18.4 W | 75 V | 19.6 W |

For a rated input voltage of 70 volts, with a fixed resistor of 42 ohms providing the sole ballasting, a 7% increase in line voltage results in a 30% increase in lamp power and a 7% decrease in line voltage results in a 42% decrease in lamp power. Similar deviations from rated line voltage in the case of an inductive ballast result in a 12% increase (or decrease) in lamp power. In the case of the specific PTC-fixed ballast resistor combination as described hereinbefore, an increase or decrease of 7% in line voltage results in only an increase or decrease of 3% in lamp power; thus the power regulation with the present circuit under conditions of varying line voltage is excellent. In addition, the circuit operation is independent of the PTC resistor-temperature characteristics although proper heat sinking of the PTC resistor is important to insure constant power dissipation therein. As a general rule, PTC switching temperatures of 100° C. or higher are desirable to reduce the influence of ambient temperature changes.

In the following Table II are provided other specific lamp designs which are ballasted by a combined PTC and fixed value resistance, in accordance with the present invention. In the case of the 15 watt, 20 watt, and 30 watt lamps as described in the following Table II, the PTC resistance and the fixed resistance are selected to provide optimum power regulating characteristics. In the case of the 40 watt lamp as described, the power regulating characteristics have been selected to be equivalent to those which are obtained with an inductive ballast, which is the conventional type of ballast used in most applications.

TABLE II

| T12 Lamp Rated Wattage | PTC Room Temp. Resistance (ohms) | Fixed Resistor Resistance (ohms) | Comments |
|---|---|---|---|
| 15 | 40 | 90 | optimum power regulating characteristics |
| 20 | 43 | 90 | optimum power regulating characteristics |
| 30 | 80 | 180 | optimum power regulating characteristics |
| 40 | 110 | 65 | power regulating characteristics equivalent to those of an inductive ballast |

As shown in the foregoing Table II, the room temperature resistance of the PTC resistor preferably is selected to be about half of the resistance of the fixed resistor, in order to achieve optimum power regulation characteristics for the circuit. These values are subject to some variation depending upon the different lamp characteristics and the resistivity temperature curve displayed by the particular PTC resistor material chosen. For best power regulation, once the circuit is stabilized at nominal line voltage, the power consumption in the PTC resistor is selected to be about the same as the power consumption in the fixed value resistor. When the line voltage increases to greater than nominal, the power consumption in the fixed resistor is greater and the power consumption in the PTC resistor remains approximately the same, so that the fixed value resistor provides the primary ballasting effect. At less than nominal line voltage, the PTC resistor provides the primary ballasting effect due to the decreased voltage drop across the fixed value resistor.

While barium titanate or modified titanates are the preferred PTC ceramic material, other suitable materials which display similar PTC characteristics can be used and such materials are desired in the aforementioned U.S. Pat. Nos. 2,976,505 and 3,044,968.

To facilitate a rapid stabilization of the circuit when it is initially started, the starting resistor 26 can be placed in heat transfer relationship with the PTC resistor 20, as in the embodiment shown in FIG. 3, so that the PTC resistor will rapidly be heated to its transition temperature. Once the lamp is started, of course, the starting resistor 26 is cut out of the circuit by the switch starter 24.

As another alternative embodiment, the switch starter 24 can be replaced by another PTC resistor having a much lower transition temperature. As noted hereinbefore, other types of starting circuits can be utilized such as those which incorporate a push-button type of switch, and such starting circuits are well known.

The foregoing combined PTC resistor and the fixed value resistor ballasting provides a very small, light, and economical ballasting device which is particularly adapted for fluorescent lamps especially designed for household-type use. Not only is the circuit very small and light, as compared to a conventional inductor ballast, but it exhibits excellent power regulation. While the lamp as described in detail is a tubular T12 20 watt size, it should be understood that the fluorescent lamp can take any of a variety of configurations in order to adapt it for household application, examples being an annular configuration or a fluorescent lamp of the partition type design, wherein the elongated discharge is made to return upon itself through a series of interior partitions, in order to reduce the overall maximum dimensions of the lamp.

What we claim is:

1. In combination, a circuit for operating a low-pressure, positive-column, mercury-vapor discharge lamp which is adapted to be operated with a predetermined AC rms voltage drop thereacross and a predetermined rms current therethrough to establish a predetermined rated power consumption therein, said discharge lamp requiring a starting voltage which exceeds said operating voltage by at least a predetermined amount, and said lamp also requiring for continuing operation the application of a reignition voltage thereacross at the beginning of each half cycle of said lamp operating voltage, which reignition voltage exceeds said lamp operating voltage by at least a predetermined amount, said circuit comprising:

a. input terminals adapted to be connected to a predetermined AC rms line voltage which is from about 120% to about 150% of said predetermined lamp rms operating voltage;

b. ballast means connected in series with said lamp to be operated, said series-connected ballast means and said lamp adapted to be connected across said input terminals, said ballast means comprising a parallel-connected positive temperature coefficient (PTC) resistor and a fixed value resistor, and the relative values of said PTC resistor and said fixed value resistor displaying the following relationships with respect to one another and with respect to said lamp to be operated:
   (i) the room temperature ohmic resistance of said PTC resistor is from about one-third of about twice the ohmic resistance of said fixed value resistor,
   (ii) the ohmic resistance of said fixed value resistor is sufficiently low to sustain a discharge in said lamp, and
   (iii) the rms voltage drop across said ballast means during operation of said ballasted lamp is at least about twenty percent of said rms lamp operating voltage to provide for adequate starting voltage for said lamp as well as providing adequate reignition voltage for said lamp at the beginning of each half cycle of said lamp operating potential;

c. said PTC resistor displaying a curve of temperature vs. resistance which breaks and rises sharply after a predetermined PTC resistor transition temperature is reached; and d. heat sink means associated with said PTC resistor to cause the resistance of said PTC resistor to be maintained during lamp operation at about said transition temperature and with a relatively constant power dissipation therein within the range of from about one-third to about one-tenth of said lamp rated power consumption, and said PTC resistor and said fixed value resistor being substantially thermally insulated from one another.

2. The combination as specified in claim 1, wherein said lamp to be operated has an elongated discharge path with electrodes operatively disposed proximate either end thereof, and a starting circuit for starting said lamp connecting across said lamp electrodes to place said lamp electrodes in series circuit with said ballast means, a starting switch being in a closed position upon initial energization of said lamp starting circuit to pass a starting current through said series-connected lamp electrodes to preheat same, and after a predetermined period of time said starting switch opening to apply lamp starting voltage across said discharge path to initiate said positive-column discharge between said electrodes.

3. The circuit combination as specified in claim 1, wherein the room-temperature resistance of said PTC resistor is about one-half the resistance of said fixed value resistor, and during normal operation of said lamp at rated line voltage, the power dissipation in said heat-sinked PTC resistor is about equal to the power dissipation in said fixed value resistor.

4. The circuit combination as specified in claim 1, wherein said PTC resistor substantially comprises barium titanate ceramic material.

5. The circuit as specified in claim 4, wherein the transition temperature of said PTC resistor is at least about 100° C.

6. The circuit as specified in claim 5, wherein the transition temperature of said PTC material is from about 120° C. to about 125° C.

* * * * *